United States Patent [19]

Graboyes

[11] Patent Number: 4,955,531

[45] Date of Patent: Sep. 11, 1990

[54] BLANK FOR USE IN FORMING A CONTAINER HAVING A ROUNDED EDGE

[76] Inventor: Herman Graboyes, Timberlake Apts., Apt. B-506, Norristown, Pa. 19401

[21] Appl. No.: 312,860

[22] Filed: Feb. 21, 1989

[51] Int. Cl.[5] ..... B65D 5/04

[52] U.S. Cl. ..... 229/182.1; 229/4.5; 229/DIG. 4

[58] Field of Search ..... 229/4.5, 182.1, DIG. 2, 229/DIG. 4

[56] References Cited

U.S. PATENT DOCUMENTS

| | | | |
|---|---|---|---|
| 416,115 | 11/1889 | Mayall | 229/DIG. 4 |
| 758,672 | 5/1904 | Mayall | 229/DIG. 4 |
| 1,102,877 | 7/1914 | Clark | 229/DIG. 4 |
| 1,482,569 | 2/1924 | Lange | 229/DIG. 4 |
| 1,565,765 | 12/1925 | Walter | 229/DIG. 4 |
| 1,821,668 | 9/1931 | Ross | 229/DIG. 4 |
| 2,043,419 | 6/1936 | Robinson | 229/DIG. 4 |
| 2,371,317 | 3/1945 | Ringler | 229/182.1 |
| 2,586,301 | 2/1952 | Castle | 229/182.1 |
| 2,634,563 | 4/1953 | Magill et al. | 229/4.5 |
| 3,526,566 | 9/1970 | McIlvain, Jr. et al. | 229/DIG. 4 |

FOREIGN PATENT DOCUMENTS

| | | | |
|---|---|---|---|
| 132413 | 5/1949 | Australia | 229/4.5 |
| 2149850 | 6/1972 | Fed. Rep. of Germany | 229/DIG. 4 |
| 444725 | 3/1936 | United Kingdom | 229/4.5 |

*Primary Examiner*—Gary E. Elkins

*Attorney, Agent, or Firm*—Panitch Schwarze Jacobs & Nadel

[57] ABSTRACT

To produce a container with a rounded edge, the container blank is scored with several substantially parallel, laterally spaced score lines adjacent the intended location of the rounded edge. When the blank is bent, a portion of the total deflection is absorbed by each score line so that the resulting container edge is a gradual curve rather than a single sharp crease. The ends of each scored region may be left unscored to further smooth the ends of the rounded container edge. Methods and apparatus for forming the above-described blank are disclosed.

3 Claims, 4 Drawing Sheets

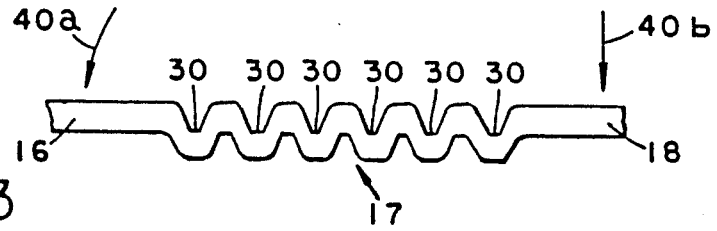
FIG. 3
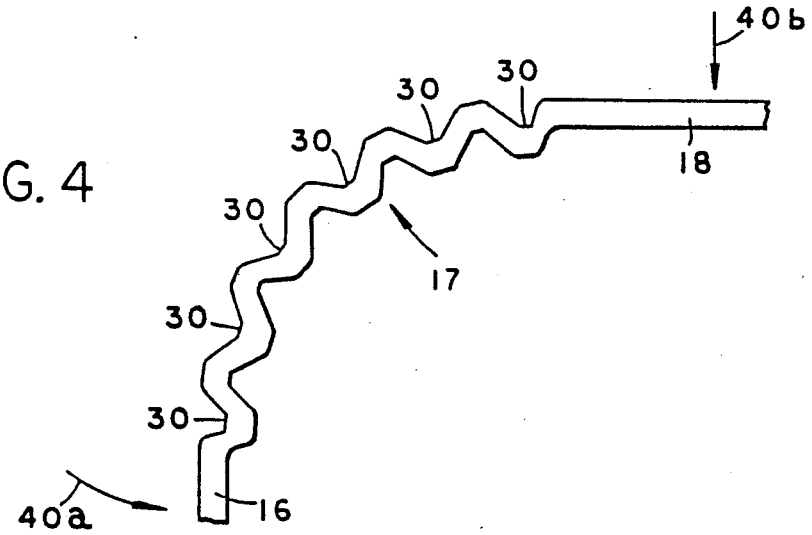
FIG. 4
FIG. 5
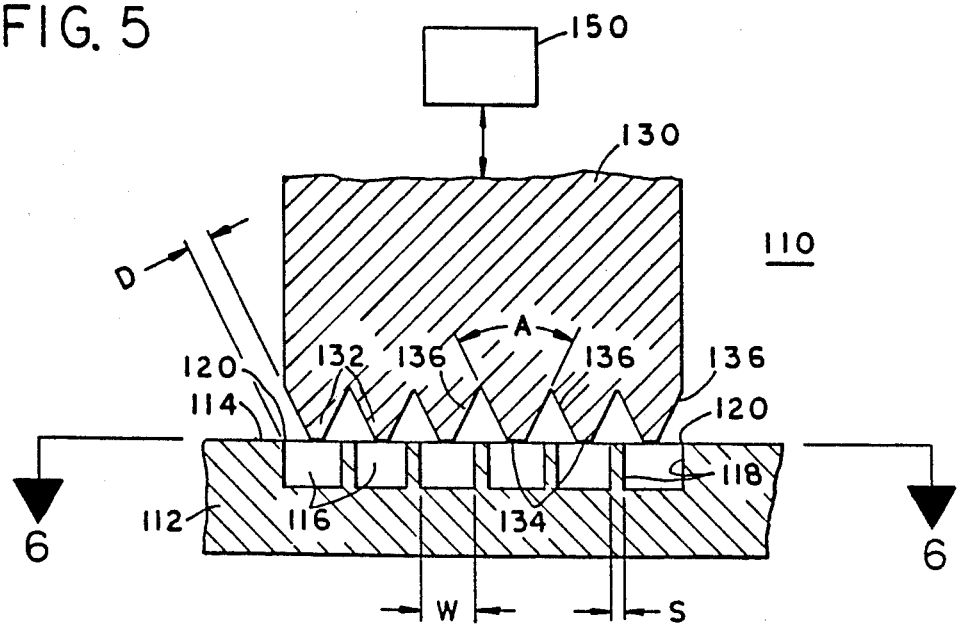

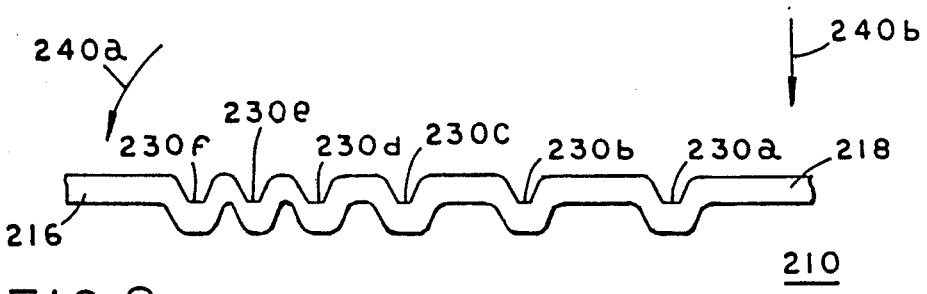
FIG. 8
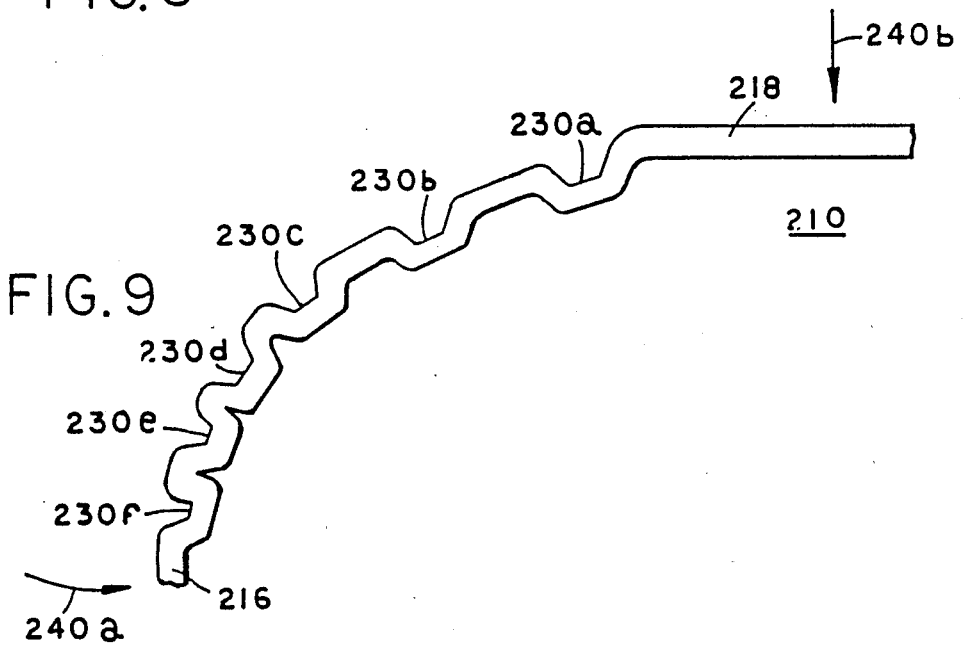
FIG. 9
FIG. 10
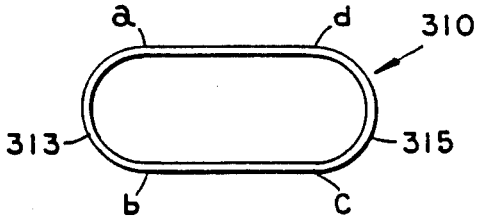
FIG. 11
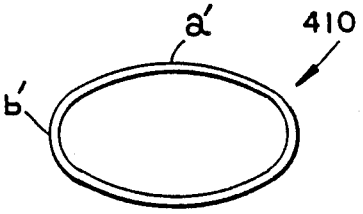

BLANK FOR USE IN FORMING A CONTAINER HAVING A ROUNDED EDGE

BACKGROUND OF THE INVENTION

This invention relates to method and apparatus for forming containers (e.g., cigarette boxes) with curved or rounded edges.

Many consumers prefer to purchase cigarettes and other products in boxes rather than soft packages. Among the reasons for this preference is the fact that a box tends to protect its contents somewhat better than a soft package. One disadvantage of boxes, however, is that they may have sharper and stiffer edges than a soft package. This may increase the wear on accessories (e.g., handbags) or articles of cloth (e.g., shirt pockets) in which the box is carried. Many consumers have also been found to prefer the "softer" feel of containers with curved or rounded edges.

The present invention comprises methods and apparatus for making containers such as cigarette boxes with curved or rounded edges and for making container blanks which, when formed into containers, automatically tend to have curved or rounded edges.

SUMMARY OF THE INVENTION

Briefly stated, the present invention emphasized a plurality of parallel, closely spaced score lines in a container blank at the intended location of each curved or rounded edge. When the blank is subsequently bent, some of the bending deflection occurs at each score line. Accordingly, the overall bending deflection is distributed over the score lines, with the result that the edge is gradual or rounded, as desired. Preferred apparatus for producing the above-described score lines includes a counter plate having a plurality of parallel, laterally spaced grooves, and a punch having a plurality of parallel, laterally spaced ridges. The container blank is placed between the counter plate and the punch, and the punch is moved toward the counter plate so that the ridges deform portions of the blank into the grooves, thereby producing the desired plurality of closely spaced score lines. If desired, a small portion of the blank adjacent the ends of the score lines may be left unscored. This advantageously smoothes the end of the edge by masking the undulations associated with the score lines.

BRIEF DESCRIPTION OF THE DRAWINGS

The foregoing summary, as well as the following detailed description, will be better understood when read in conjunction with the appended drawings. For purposes of illustrating the invention, there is shown in the drawings embodiments which are presently preferred, it being understood, however, that this invention is not limited to the precise arrangements as shown. In the drawings:

FIG. 3 is an enlarged sectional view taken along line 3—3 of FIG. 1;

FIG. 4 shows the structure of FIG. 3 after bending through an angle of 90° to form the container;

FIG. 5 is a partial sectional view of apparatus constructed in accordance with this invention which can be used to form a blank of the type shown in FIG. 1;

FIGS. 8 and 9 are views respectively similar to FIGS. 3 and 4 showing portions of container blanks in accordance with an alternative embodiment of the invention;

FIG. 10 is a view generally similar to FIG. 2 showing yet another alternative embodiment of the invention; and FIG. 11 is a view generally similar to FIG. 2 showing still another alternative embodiment of the invention.

DETAILED DESCRIPTION OF THE INVENTION

Figure 1:
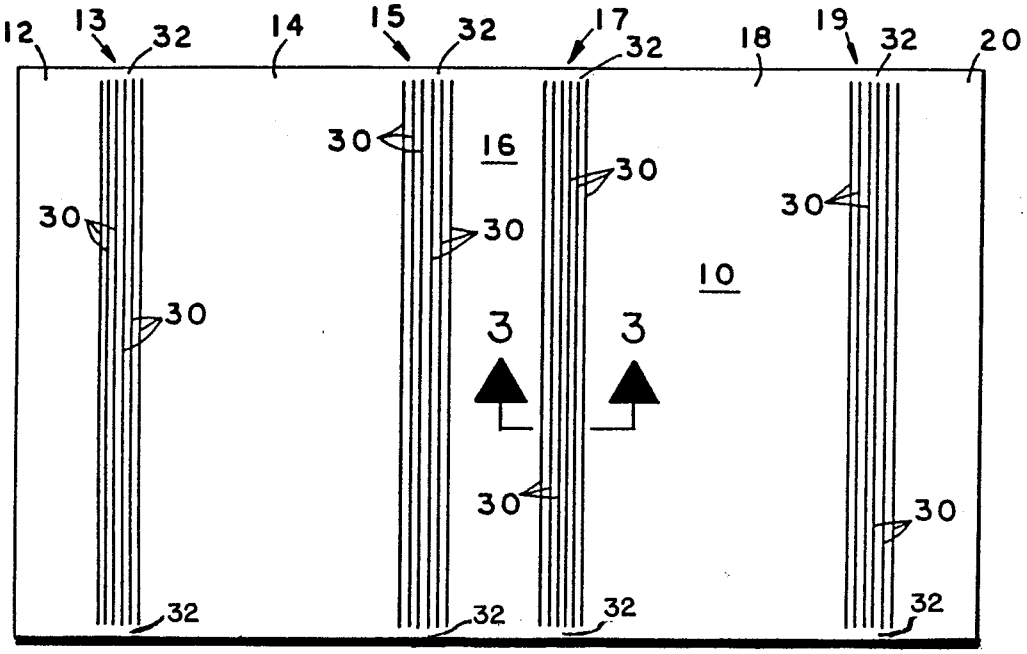
FIG. 1 is a top plan view of a major portion of a container blank embodying the present invention and showing the surface of the container blank that will be, for the most part, on the outside of the assembled container.

Referring to the drawings, wherein like numerals indicate like elements throughout, there is shown in FIG. 1 a portion of a typical cigarette box blank 10 embodying the present invention. For simplicity, blank 10 is shown without all of the components required to form a top and/or bottom of the box, but such components are well known and could be either integral with or separate from blank 10 (e.g. a top and/or bottom could be formed separately and then glued onto the remainder of the container). Blank 10 includes a front panel 14 and rear panel 18 which are integrally connected by right side panel 16. Left side panel 12 extends to the left (when viewing FIG. 1) from front panel 14, and side tab panel 20 extends to the right from rear panel 18. A typical material for blank 10 is 0.012 inch thick cardboard, but any other suitable material of any desired thickness and/or size could alternatively be employed.

Figure 2:
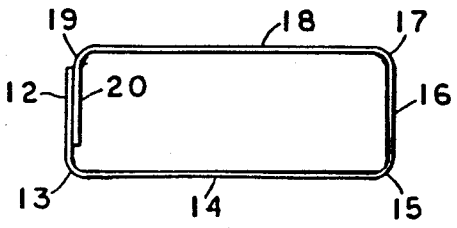
FIG. 2 is an end view of a container made from the blank of FIG. 1.

In the finished container or box made from blank 10 (see FIG. 2), the panels 12, 14, 16 and 18 are bent or folded so that the front and rear panels 14 and 18 are generally parallel and the right and left side panels 16 and 12 are generally parallel and generally perpendicular to the front and rear panels. The left side panel 12 is glued or otherwise secured over side tab panel 20 and the top and bottom of the box (not shown) are assembled in any known manner.

At the intended locations of each of the four vertical edges 13, 15, 17 and 19 of the box, blank 10 has a plurality of score lines 30 extending along most (but preferably not quite all) of the height of the blank parallel to the longitudinal axis of the associated intended edge. In the particular embodiment shown in FIGS. 1-4, six parallel, laterally spaced score lines 30 are provided at the location of each intended vertical edge. In this embodiment, all of score lines 30 are preferably identical to one another, and within each group the score lines are preferably evenly spaced from one another. A greatly enlarged cross section of blank 10 at the locations of one typical group of score lines 30 is shown in FIG. 3.

As a result of the presence of score lines 30, when blank 10 is bent or folded during assembly of the box about the longitudinal axis of any of the intended vertical edges of the box (see, for example, FIGS. 3 and 4 in which bending forces are represented by arrows 40*a* and 40*b*, and in which FIG. 4 shows the structure of FIG. 3 after bending), a gradual or rounded edge automatically results. This is because each of score lines 30 absorbs a portion of the total bending deflection so that the total deflection is distributed substantially uniformly among the score lines 30. Accordingly, the resulting edge curvature is spread out along the width of the scored region, which becomes a gradual arc rather than a sharp crease or fold as in prior art boxes. A typical radius of curvature in accordance with the present invention is approximately 0.125 inch (one-eighth of an inch). Note that the curved edge forms naturally without the need for a special forming tool or support in contact with the edge to give the desired shape.

As mentioned above, the extreme upper and lower ends 32 of each region of score lines 30 are unscored for a short distance (e.g., a distance approximately 0.012 inch in the depicted embodiment). These short unscored end regions 32 do not in any way interfere with the formation of rounded edges as described above. The advantage of unscored end regions 32 is that they tend to smooth out the extreme ends of each rounded edge by, in effect, masking and/or cushioning any possibly sharp edges or corners associated with score lines 30. Accordingly, unscored end regions 32 even further reduce the tendency of the finished box to cause wear of the accessory or article of clothing in which the box is carried.

Figure 6:
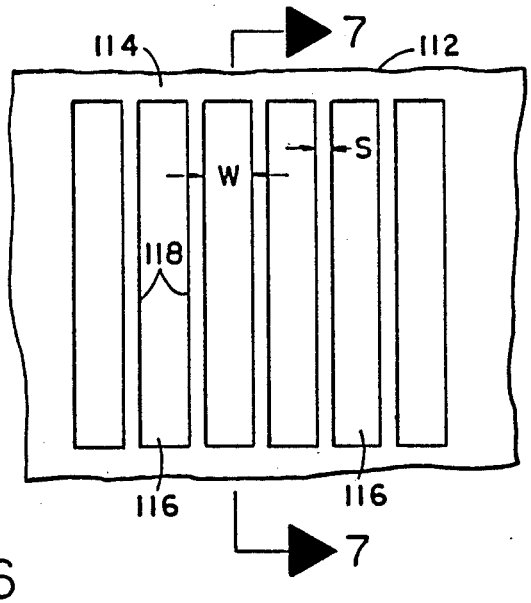
FIG. 6 is a plan view of a portion of the apparatus of FIG. 5, taken along the line 6—6 of FIG. 5.
Figure 7:
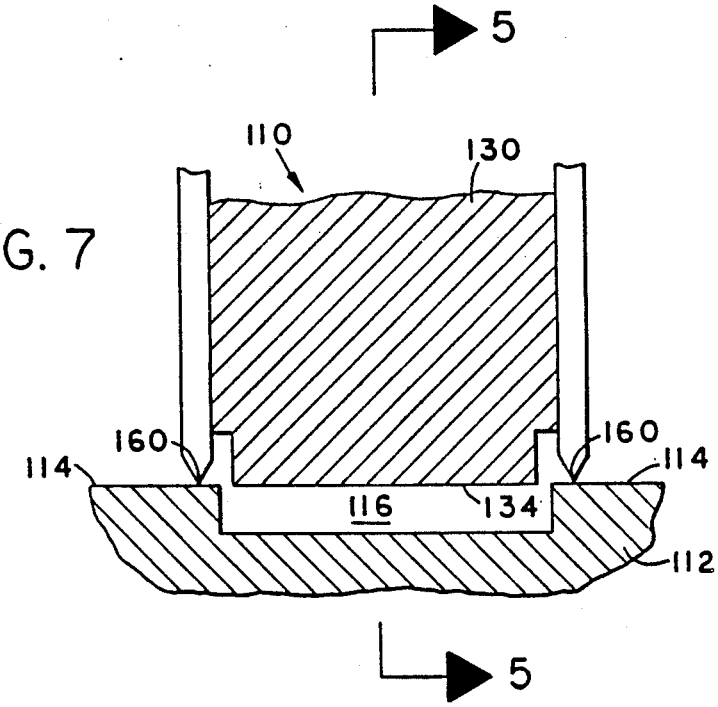
FIG. 7 is a partial sectional view of the apparatus of FIGS. 5 and 6 taken along line 7—7 of FIG. 6.

Preferred apparatus 110 for forming score lines 30 and associated elements is illustrated by FIGS. 5–7. Prior to scoring, blank 10 (or the stock from which blank 10 will be cut) is laid out on the substantially flat upper surface 114 of counter plate 112. Below the intended location of each score line 30, counter plate 112 has a groove 116. In the depicted preferred embodiment, each groove is deeper than the thickness of blank 10 (e.g., 0.014 inch deep when blank 10 is 0.012 inch thick) and more than twice as wide as the thickness of the blank (e.g., 0.031 inch wide when the blank is 0.012 inch thick). Also in the depicted preferred embodiment, the spacing S between adjacent grooves is preferably less than the thickness of the blank (e.g., 0.008 inch when blank 10 is 0.012 inch thick). The side surfaces 118 of each groove 116 are preferably planar and perpendicular to surface 114. In addition, surfaces 118 meet surface 114 at right angled corners 120. However, it will be appreciated by those skilled in the art that the groove depth, the groove width, the groove spacing S, the number of grooves, the shape of the grove side surface and other features of the counter plate 112 may be varied to provide variations in the score lines and, thus the curvature of the resulting box edge.

A punch 130 is located above counter plate 112 for cooperation therewith. Punch 130 has a downwardly extending ridge 132 centrally aligned with each groove 116. The apex surface 134 of each ridge 132 is preferably substantially flat and parallel to surface 114. In addition, in this embodiment, all of apex surfaces 134 are co-planar. The side surfaces 136 of each ridge 132 are preferably substantially planar and anticlinal in the direction away from the associated apex. In particular, the include angle A between each pair of side surfaces 136 is preferably in the range from about 0° to about 45°. The width of each apex surface 134 is preferably less than the thickness of blank 10 (e.g., 0.005 inch when blank 10 is 0.012 inch thick). It will be appreciated by those skilled in the art that the alignment of the ridges 132 with the grooves 116, the shape of the apex surface 134 of the ridges, the shape of the side surfaces of the ridges, the width of each apex surface 134, and all of the other features pertaining to the punch 130 may be varied to provide variations in the structure of the score lines to vary the curvature of the resulting box edge.

Means 150 (e.g., a conventional doubleacting hydraulic or pneumatic ram) are provided for vertically reciprocating punch 130. On the downward stroke, punch 130 preferably moves down until apex surfaces 134 are approximately co-planar with surface 114. (Note that with the dimensions given above, when punch 130 is in this position, the smallest corner 120 is preferably approximately equal to the thickness of blank 10 (i.e., 0.012 inch).) Accordingly, when a blank 10 is in place on surface 114, the lowering of punch 130 causes each ridge 132 to deform the adjacent portion of the blank down into the associated channel 116, thereby forming a score line 30 in the blank at the location of each ridge 132. When punch 130 is subsequently raised by element 150, the score lines 30 remain in the blank. Note that score lines 30 are preferably on the convex outward side when the blank is subsequently bent (see FIG. 4).

To produce the unscored portions 32 at each end of the scored regions, ridges 132 are slightly shorter than grooves 116 (see FIG. 7). For example, each groove 116 may extend beyond each end of the associated ridge 132 by a distance approximately equal to the thickness of blank 10 (e.g., 0.012 inch). In addition, the knife edge 160 that cuts through the blank adjacent the ends of the scored regions may be spaced beyond the end of grooves 116 by a further distance approximately equal to the thickness of the blank (e.g., 0.012 inch). The combination of grooves 116 longer than ridges 132 and knife edge 160 beyond the end of grooves 116 ensures a small but well defined unscored region 32 at each end of each scored region. This region 32 is preferably long enough parallel to the longitudinal axes of the adjacent score lines 30 so that when the blank is bent as illustrated, for example, by FIG. 4, the otherwise fluted end of the curved container edge will be substantially smoothed out. On the other hand, region 32 is preferably not so long that it interferes with the above-described functioning of the associated scored region to produce a rounded container edge when the blank is bent. In other words, when the blank is bent, unscored region 32 follows the overall curvature of the associated scored region, but does not follow all of the minute undulations of the scored region. Accordingly, unscored regions 32 advantageously smooth out each end of each scored region in the finished container.

The curvature of the container edges produced in accordance with this invention can be altered by changing various parameters of the scoring apparatus. For example, more gradual curves with a larger radius of curvature tend to result from such factors as (1) the use of shallower score lines, (2) the use of wider score lines (which can be produced, for example, by increasing the width W of grooves 116), (3) increasing the spacing between adjacent score lines, and/or (4) increasing the number of score lines. Sharper edges with a smaller radius of curvature tend to result from such factors as (1) the use of deeper score lines, (2) decreasing the spacing between adjacent score lines, and/or (3) reducing the included angle A of ridges 132.

These techniques for varying the radius of curvature can be employed to produce container edges having compound curvature (i.e., edges having one radius of curvature in one axial or arcuate region and a different radius of curvature in another axial or arcuate region). For example, edges which approximate arcs of ovals can be produced by having the score lines progress from fairly far apart to fairly close together as one proceeds from the portion of the oval arc having the larger radius of curvature to the portion of the arc having the smaller radius of curvature. This is illustrated by FIGS. 8 and 9 in which score lines 230*a* and 230*b* are relatively close together, and intermediate score line spacing is used for the score lines in between. As a consequence, when blank 210 is bent as shown in FIG. 9, the resulting rounded edge has a relatively large radius of curvature in the region of score lines 230*a* and 230*b*, and a smaller radius or curvature adjacent score lines 230*e* and 230*f*.

Although in the embodiments shown in FIGS. 1–4, 8 and 9, each rounded edge forms a 90° angle, this is not necessarily the case. For example, FIG. 10 shows a package 310 produced in accordance with this invention in which the scored regions extend from point a to point b and from point c to point d. Accordingly, package 310 has two rounded edges 313 and 315, each of which forms an angle of 180°. In FIG. 11, the principle illustrated in FIG. 9 is extended to produce a package 410 which is substantially oval-shaped.

It will be understood that the foregoing description is merely illustrative of the principles of the invention, and that various modifications can be made to the above-described embodiments by those skilled in the art without departing from the scope or spirit of the invention. For example, the particular dimensions given above are merely illustrative of preferred embodiments. Other dimensions can be employed, if desired. It is understood, therefore, that this invention is not limited to the particular embodiments disclosed, but is intended to cover any modifications which are within the spirit and scope of the invention as defined by the claims.

I claim:

1. A blank for use in forming a container having a curved edge with a longitudinal axis comprising:

a plurality of longitudinal, substantially parallel, laterally spaced score lines for forming the edge, each of said score lines having a longitudinal axis which is substantially parallel to the longitudinal axis of said edge so that when said blank is bent about said longitudinal edge axis, said blank bends at each score line and the edge is therefore curved by virtue of the bending deflection being distributed over said plurality of score lines, the lateral spacing between adjacent score lines being varied to distribute the bending deflection unevenly for providing a curved edge having a variable radius of curvature.

2. A bland for use in forming a container having a rounded edge with a longitudinal axis comprising:

a plurality of longitudinal, substantially parallel, laterally spaced score lines for forming the edge, each of said score lines having a longitudinal axis which is substantially parallel to the longitudinal axis of said edge, a first end portion of said blank adjacent at least one end of said score lines being left unscored, so that when said blank is bent about said longitudinal edge axis, said blank bends at each score line and the edge is therefore rounded by virtue of the bending deflection being distributed over said plurality of score lines, said unscored portion being of sufficient length parallel to said score lines to substantially smooth the first end of said blank edge when said blank is bent, but not so long as to interfere with the rounded formation of said edge or to fail to follow the overall curvature of said edge.

3. The blank defined in claim 2 wherein said blank has a predetermined thickness, and wherein the length of said unscored portion parallel to said score lines is approximately equal to said thickness.

* * * * *